US010145646B2

(12) United States Patent
Kelly

(10) Patent No.: US 10,145,646 B2
(45) Date of Patent: Dec. 4, 2018

(54) ARCHERY BOWSTRING RELEASE ENABLING SENSITIVITY ADJUSTMENT

(71) Applicant: Scott Archery LLC, Clay City, KY (US)

(72) Inventor: Daniel N. Kelly, Rochester, NY (US)

(73) Assignee: Scott Archery LLC, Clay City, KY (US)

( * ) Notice: Subject to any disclaimer, the term of this patent is extended or adjusted under 35 U.S.C. 154(b) by 0 days.

(21) Appl. No.: 14/941,084

(22) Filed: Nov. 13, 2015

(65) Prior Publication Data

US 2016/0138887 A1 May 19, 2016

Related U.S. Application Data

(60) Provisional application No. 62/079,219, filed on Nov. 13, 2014.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 228,302 A 6/1880 Beard
229,089 A 6/1880 Burnham
2,819,707 A 1/1958 Kayfes et al.
3,009,454 A 11/1961 Graham
3,656,467 A 4/1972 Halter
3,757,763 A 9/1973 Pinti et al.
3,768,456 A 10/1973 Hansen et al.
3,853,111 A 12/1974 Stanislawski et al.
3,921,668 A 11/1975 Self
3,942,507 A 3/1976 Opal
3,954,095 A 5/1976 Lewis
3,965,884 A 6/1976 Killian
4,036,204 A 7/1977 Scott
4,041,926 A 8/1977 Troncosco, Jr. et al.
4,066,060 A 1/1978 Troncosco, Jr. et al.
4,160,437 A 7/1979 Fletcher
4,282,851 A 8/1981 Lyons
4,305,208 A 12/1981 Larson
4,391,263 A 7/1983 Dodge
4,392,475 A 7/1983 Fletcher
4,407,260 A 10/1983 Lyons
4,424,791 A 1/1984 Muehleisen
4,426,989 A 1/1984 Sutton
4,466,418 A 8/1984 Jones
(Continued)

OTHER PUBLICATIONS

Bow Lock downloaded from http://www.archeryhistory.com/releases/releasespics/release5.jpg on Dec. 23, 2009.
(Continued)

*Primary Examiner* — Melba Bumgarner
*Assistant Examiner* — Amir Klayman
(74) *Attorney, Agent, or Firm* — Barclay Damon LLP

(57) ABSTRACT

A bowstring release is described herein. The bowstring release has, in an embodiment, a release body and a hook for holding a bowstring. The bowstring release includes a hook engager configurable to adjust the sensitivity of the bowstring release.

20 Claims, 19 Drawing Sheets

(56) References Cited

U.S. PATENT DOCUMENTS 4,498,448 A 2/1985 Fletcher
4,509,497 A 4/1985 Garvison
4,539,968 A 9/1985 Garvison
4,567,875 A 2/1986 Fletcher
4,569,744 A 2/1986 Walker
4,574,767 A 3/1986 Gazzara
4,584,747 A 4/1986 Katterbach et al.
4,600,622 A 7/1986 Carlson et al.
4,607,947 A 8/1986 Ensing et al.
4,612,907 A 9/1986 Gantt
4,620,523 A 11/1986 Peck
4,625,705 A 12/1986 Willits
4,672,945 A 6/1987 Carlton
4,674,469 A 6/1987 Peck
4,831,997 A 5/1989 Greene
4,854,293 A 8/1989 Roberts
D303,420 S 9/1989 Huber
4,881,516 A 11/1989 Peck
4,887,583 A 12/1989 Lin
4,930,485 A 6/1990 Kopper
4,949,698 A 8/1990 Burnham
4,981,128 A 1/1991 Garvison
4,982,718 A 1/1991 Hamm et al.
5,009,214 A 4/1991 Wilde
5,025,772 A 6/1991 Stevenson
5,056,498 A 10/1991 Scherz
5,056,586 A 10/1991 Bemisderfer
5,056,916 A 10/1991 Scherz
5,092,053 A 3/1992 Roberts
5,146,908 A * 9/1992 Larson ..... F41B 5/10 124/25.6
5,184,596 A 2/1993 Green et al.
5,205,268 A 4/1993 Savage
5,215,504 A 6/1993 Wong et al.
5,224,463 A 7/1993 Townsend
5,247,922 A 9/1993 Lalonde
5,261,581 A 11/1993 Harden
5,273,021 A 12/1993 Tepper
5,307,966 A 5/1994 Inaba et al.
5,323,754 A 6/1994 Pittman et al.
5,424,813 A 6/1995 Schlueter et al.
5,448,983 A 9/1995 Scott
5,460,721 A 10/1995 Goodwin
5,481,807 A 1/1996 Ploot
5,546,924 A 8/1996 Todd
5,554,329 A 9/1996 Monkelbaan et al.
5,595,167 A 1/1997 Scott
5,596,977 A 1/1997 Scott
5,615,662 A 4/1997 Tentler et al.
5,653,214 A 8/1997 Lynn
5,685,286 A 11/1997 Summers
5,692,490 A 12/1997 Walker
5,694,915 A 12/1997 Summers
5,702,494 A 12/1997 Tompkins et al.
5,765,536 A 6/1998 Scott
5,779,904 A 7/1998 Ruderman et al.
5,803,068 A 9/1998 Summers
5,842,916 A 12/1998 Gerrity et al.
5,850,825 A 12/1998 Scott
5,934,679 A 8/1999 Strain et al.
5,937,841 A 8/1999 Summers et al.
5,937,842 A 8/1999 Summers et al.
5,941,225 A 8/1999 Tentler et al.
6,032,661 A 3/2000 Goff et al.
6,302,093 B1 10/2001 Holland
6,478,020 B1 11/2002 Rentz
6,481,430 B1 11/2002 Lightcap, Jr.
6,481,431 B1 11/2002 Summers
6,508,005 B2 1/2003 Springer
6,567,593 B1 5/2003 Sugawara
6,571,786 B2 6/2003 Summers et al.
6,584,966 B1 7/2003 Summers et al.
6,606,984 B2 8/2003 Mugg
6,631,709 B2 10/2003 Carter et al.
6,647,976 B2 11/2003 Summers et al.
6,659,378 B2 12/2003 Di Anna
6,736,124 B2 5/2004 Carter
6,763,819 B2 7/2004 Eckert
6,796,037 B1 9/2004 Geffers et al.
6,895,951 B2 5/2005 Summers et al.
6,925,996 B1 8/2005 Todd
6,945,241 B2 9/2005 Pellerite
6,953,035 B1 10/2005 Summers et al.
6,957,644 B2 10/2005 Simo et al.
D546,916 S 7/2007 Schwerman et al.
7,278,415 B2 10/2007 Jones
D558,915 S 1/2008 Kakuno et al.
7,325,539 B2 2/2008 Simo et al.
D597,164 S 7/2009 Jones
7,574,999 B2 8/2009 Pardoski, Jr.
7,581,536 B2 9/2009 Porter
7,603,784 B2 10/2009 Erhard
7,654,254 B1 2/2010 Rentz et al.
7,753,043 B1 7/2010 Eckert
7,926,475 B2 4/2011 Jones
7,946,282 B2 5/2011 Jones
8,082,910 B1 12/2011 Yehle
8,146,578 B2 4/2012 Jones
8,161,956 B2 4/2012 Bednar
8,622,051 B2 1/2014 Summers
8,869,781 B2 10/2014 Jones
9,027,540 B2 5/2015 Springer
9,429,384 B2 * 8/2016 Whalen ..... F41B 5/1469
9,857,139 B2 1/2018 Kelly et al.
9,863,736 B2 1/2018 Kelly et al.
9,891,019 B2 2/2018 Haas et al.
2003/0037778 A1 2/2003 Carter et al.
2003/0154969 A1 8/2003 Carter
2003/0159682 A1 8/2003 Pellerite
2003/0230295 A1 12/2003 Jones
2004/0079351 A1 4/2004 Summers et al.
2005/0183272 A1 8/2005 Meadows
2007/0181113 A1 8/2007 Porter
2007/0277471 A1 12/2007 Gibson
2008/0149084 A1 6/2008 Whalen et al.
2008/0251059 A1 10/2008 McPherson
2008/0282560 A1 11/2008 Bradley et al.
2009/0056689 A1 3/2009 Jones
2009/0090342 A1 4/2009 Freitag et al.
2009/0095270 A1 4/2009 Graves
2009/0159395 A1 6/2009 Gerrity et al.
2009/0185868 A1 7/2009 Masters et al.
2010/0064535 A1 3/2010 Kingsbury
2010/0071909 A1 3/2010 Winn
2010/0108047 A1 5/2010 Jones
2011/0144639 A1 6/2011 Govari
2011/0162669 A1 7/2011 Kurek et al.
2011/0168146 A1 7/2011 Deceuster
2012/0285431 A1 1/2012 Summers
2012/0192844 A1 8/2012 Springer
2013/0025578 A1 1/2013 Jones
2013/0092140 A1 4/2013 Rentz
2018/0010888 A1 1/2018 Finley

OTHER PUBLICATIONS

Various prior art releases (1) downloaded from http://www.archeryhistory.com/releases/releasespics/pse.jpg, on Dec. 23, 2009.
Various prior art releases (2) http://www.archeryhistory.com/releases/releasespics/release4.jpq on Dec. 23, 2009.
Mamba R1 Swing Away E-Z Adjust downloaded from http://www.cobraarchery.com/c569.html, on Mar. 10, 2010.
Prior art releases (3) downloaded from http://www.archerhistory.com/releases on Jul. 21, 2011.
Prior art releases (4) downloaded from http://www.archerhistory.com/releases on Jul. 21, 2011.
Longhorn Hunter (2010).
HBC, Sep. 23, 2014, T.R.U. Ball Archery, downloaded from https://web.archive.org/web/20140923155023/http://www.truball.com/HBC.html, on Oct. 29, 2015.
Fang Series, Sep. 23, 2014, T.R.U. Ball Archery, downloaded from https://web.archive.org/web/20140923155053/http://www.truball.com/fang_handles.html, on Oct. 29, 2015.

(56) References Cited

OTHER PUBLICATIONS

Handles, Sep. 23, 2014, T.R.U. Ball Archery, downloaded from https://web.archive.org/web/20140923072741/http://www.truball.com/HT.html, on Oct. 29, 2015.
Carter, Jun. 21, 2014, Carter Enterprises, downloaded from https://web.archive.org/web/20140621222748/http://www.carterenterprises.com/, on Oct. 29, 2015.
Too Simple, Feb. 17, 2014, Carter Enterprises, downloaded from https://web.archive.org/web/20140217215231/http://www.carterenterprises.com/releases/thumb-trigger/too-simple, on Oct. 29, 2015.
Simple 1, Feb. 17, 2014, Carter Enterprises, downloaded from https://web.archive.org/web/20140217222911/http://www.carterenterprises.com/releases/thumb-trigger/simple-1, on Oct. 29, 2015.
Attraction L, Feb. 17, 2014, Carter Enterprises, downloaded from https://web.archive.org/web/20140217112335/http://www.carterenterprises.com/releases/thumb-trigger/attraction, on Oct. 29, 2015.

* cited by examiner

ARCHERY BOWSTRING RELEASE ENABLING SENSITIVITY ADJUSTMENT

CROSS-REFERENCE TO RELATED APPLICATION

This application is a non-provisional of, and claims the benefit and priority of, U.S. Provisional Patent Application No. 62/079,219, filed on Nov. 13, 2014. The entire contents of such application are hereby incorporated by reference.

BACKGROUND

Many archers use handheld release accessories to help them with grasping and releasing bowstrings. Each archer has a particular preference as to the desired sensitivity of the release. In addition, the sensitivity of the desired release may change based on the shooting circumstances. However, typically, a release has a set sensitivity or amount of force needed to sufficiently change the position of the release to cause the hook to release the bowstring. In order to change the sensitivity, the archer typically must change from one type of release to another. This requires that the archer carry a variety of releases, which can be inconvenient and expensive. The foregoing background describes some, but not necessarily all, of the problems, disadvantages and shortcomings related to typical archery releases.

SUMMARY

In an embodiment, the bowstring release includes a release body defining a cavity and a hook pivotally coupled to the release body. The hook is configured to hold a bowstring. A ring is at least partially positioned within the cavity, and a sensitivity adjustment device is coupled to the ring. The sensitivity adjustment device includes a head configured to be moved relative to the release body through a range of head positions. A hook engager is pivotally coupled to the release body. The hook engager is configured to engage the hook when the hook holds the bowstring, and the hook engager is pivotal between a plurality of hook engager positions. A ring lock is operable to maintain a position of the ring relative to the release body. The bowstring release is operable in an adjustment mode in which: (a) the head is configured to receive an adjustment force; (b) the ring is configured to rotate relative to the release body in response to the adjustment force, wherein the rotation occurs through a range of ring positions; (c) the hook engager is configured to pivot in response to the rotation; and (d) the ring lock is configured to secure the ring in a desired one of the ring positions so as to maintain the hook engager in one of the hook engager positions. The bowstring release is operable in a shooting mode in which the hook is configured to disengage from the hook engager based, at least in part, on the hook engager position. The disengagement causes the bowstring to be released.

In another embodiment, the bowstring release includes a release body defining a cavity and a hook moveably coupled to the release body. The hook is configured to hold a bowstring. A linkage system is positioned at least partially within the cavity. The linkage system includes a first ring moveably coupled to the release body. The first ring is at least partially positioned in the cavity. The linkage system also includes a tab coupled to the first ring and extending through the release body to rotate the first ring. The linkage system additionally includes a second ring engaging the first ring and a sear pivotally coupled to the release body. The sear includes a hook engager portion configured to engage the hook when the hook holds the bowstring. The linkage system further includes a position retainer configured to maintain a position of the first ring. In response to operation of the tab to adjust the bowstring release prior to coupling the hook to the bowstring, (a) the first ring is configured to rotate and (b) the sear is configured to rotate in response to rotation of the first ring. Rotation of the sear changes a position of the hook engager portion relative to the hook, thereby changing a sensitivity of the bowstring release.

In yet another embodiment, the bowstring release includes a release body defining a cavity and a hook moveably coupled to the release body. The hook is configured to hold a bowstring. A linkage system is positioned at least partially within the cavity. The linkage system includes: (a) a first ring rotatably coupled to the release body, wherein the first ring is at least partially positioned in the cavity; and (b) a second ring at least partially positioned in the cavity and configured to retain the first ring in the cavity. A tab is coupled to the first ring and extends through the release body to rotate the first ring. A linkage member is pivotally coupled to the first ring at a first end of the linkage member, and a sear is pivotally coupled to a second end of the linkage member. The sear includes a hook engager portion configured to block the hook when the hook holds the bowstring. A position retainer is coupled to the release body and configured to maintain a position of the first ring relative to the release body. A first friction member is coupled to the first ring, and a second friction member is coupled to the release body. The second friction member is configured to cooperatively engage the first friction member to facilitate controlling the rotation of the first ring relative to the release body. In response to operation of the tab to adjust the bowstring release prior to coupling the hook to the bowstring, (a) the first ring is configured to rotate, (b) the linkage member is configured to change position, and (c) the sear is configured to rotate in response to the change in position of the linkage member. The rotation of the sear changes a position of the hook engager portion relative to the hook, thereby changing a sensitivity of the bowstring release.

Additional features and advantages of the present disclosure are described in, and will be apparent from, the following Brief Description of the Drawings and Detailed Description.

DETAILED DESCRIPTION

Figure 1:
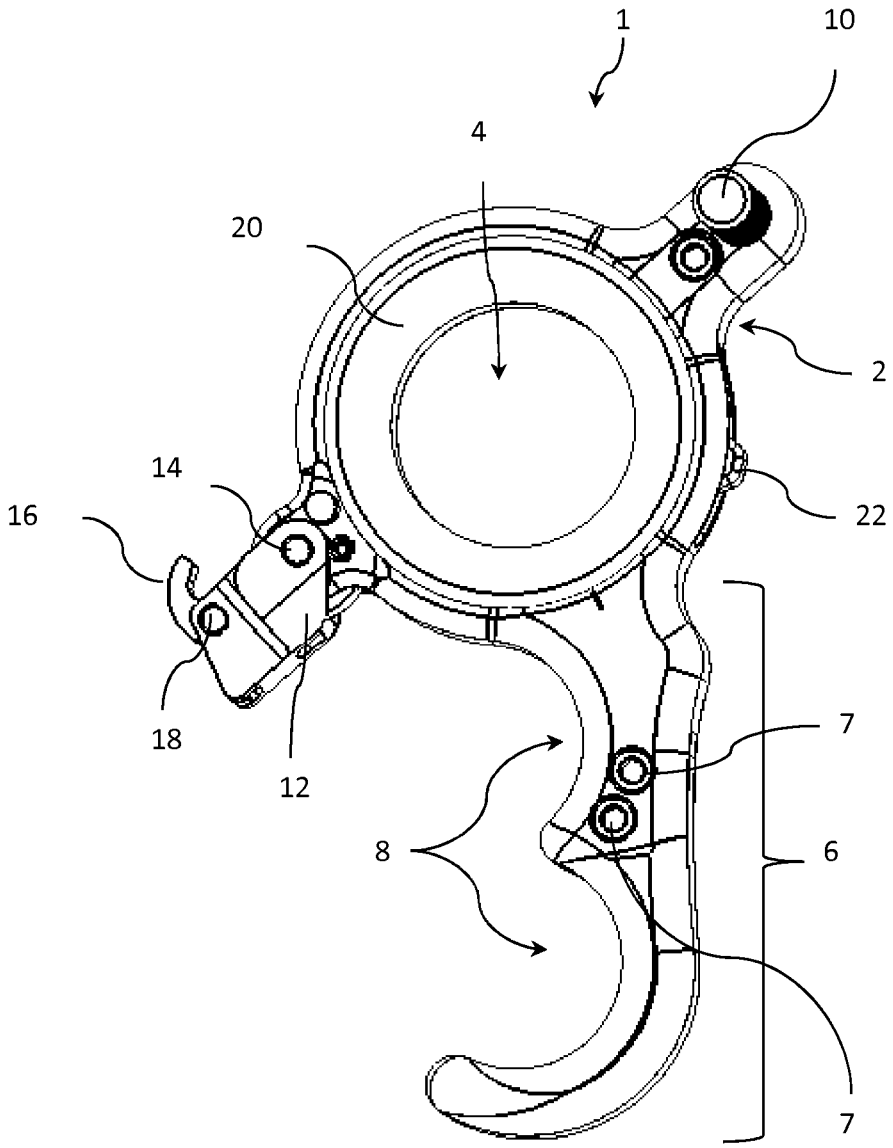
FIG. 1 is a side view of an embodiment of an archery release.
Figure 2:
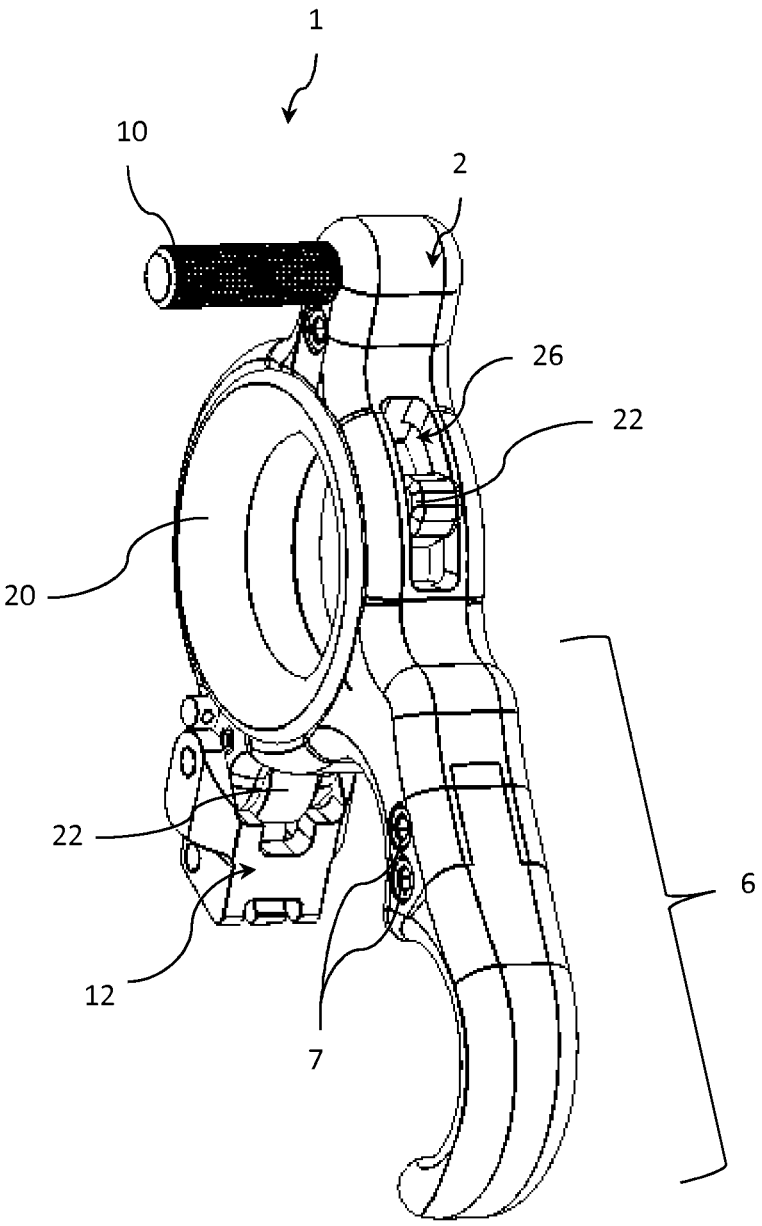
FIG. 2 is a rear isometric view of an embodiment of the archery release.
Figure 3:
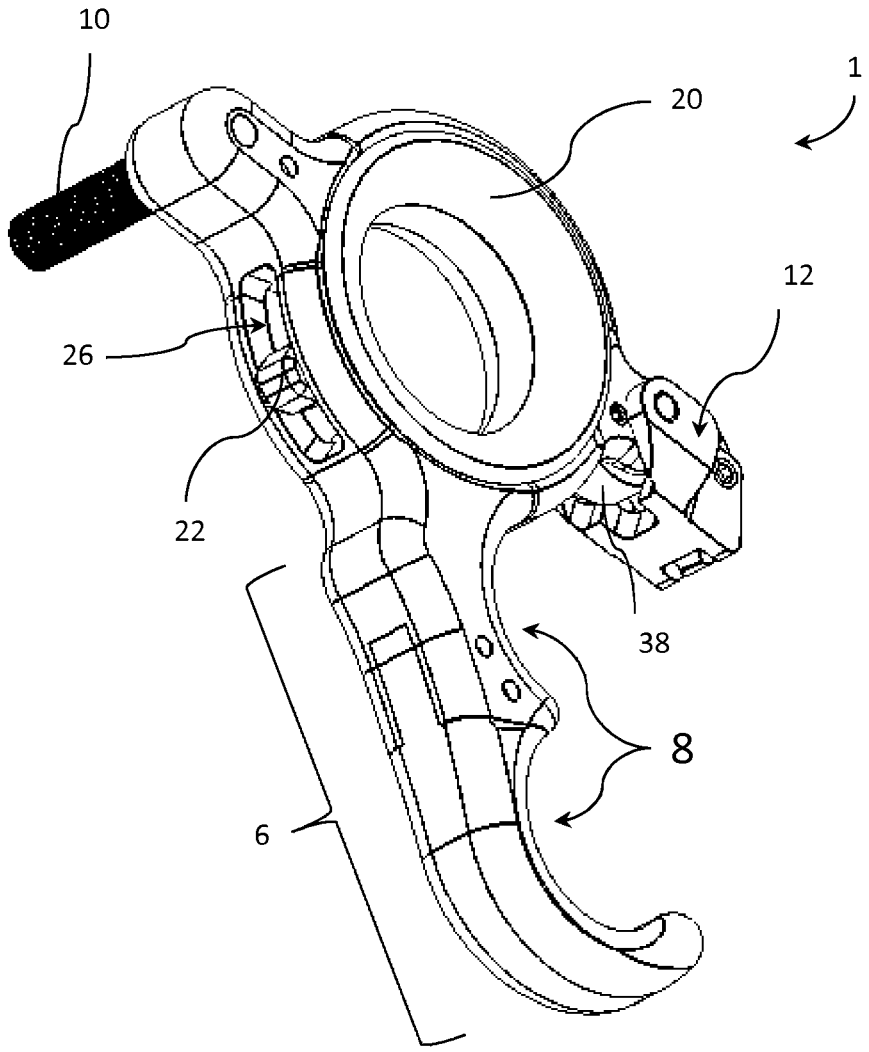
FIG. 3 is another rear isometric view of an embodiment of the archery release.
Figure 4:
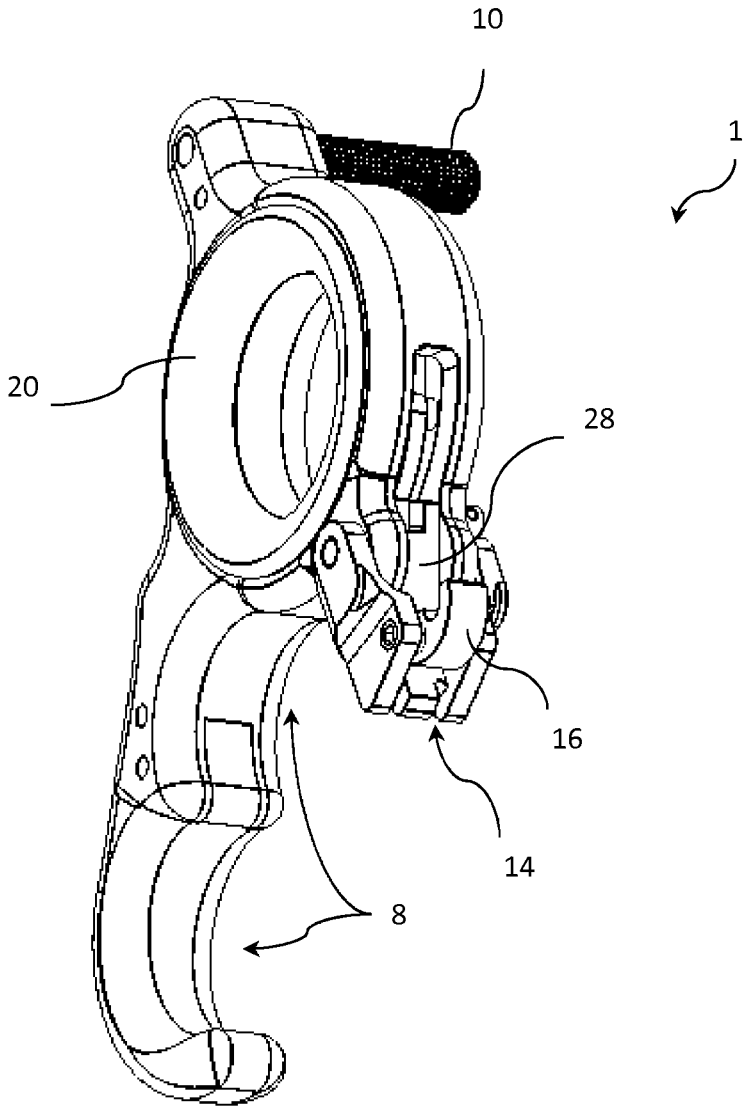
FIG. 4 is a top isometric view of an embodiment of the archery release.
Figure 5:
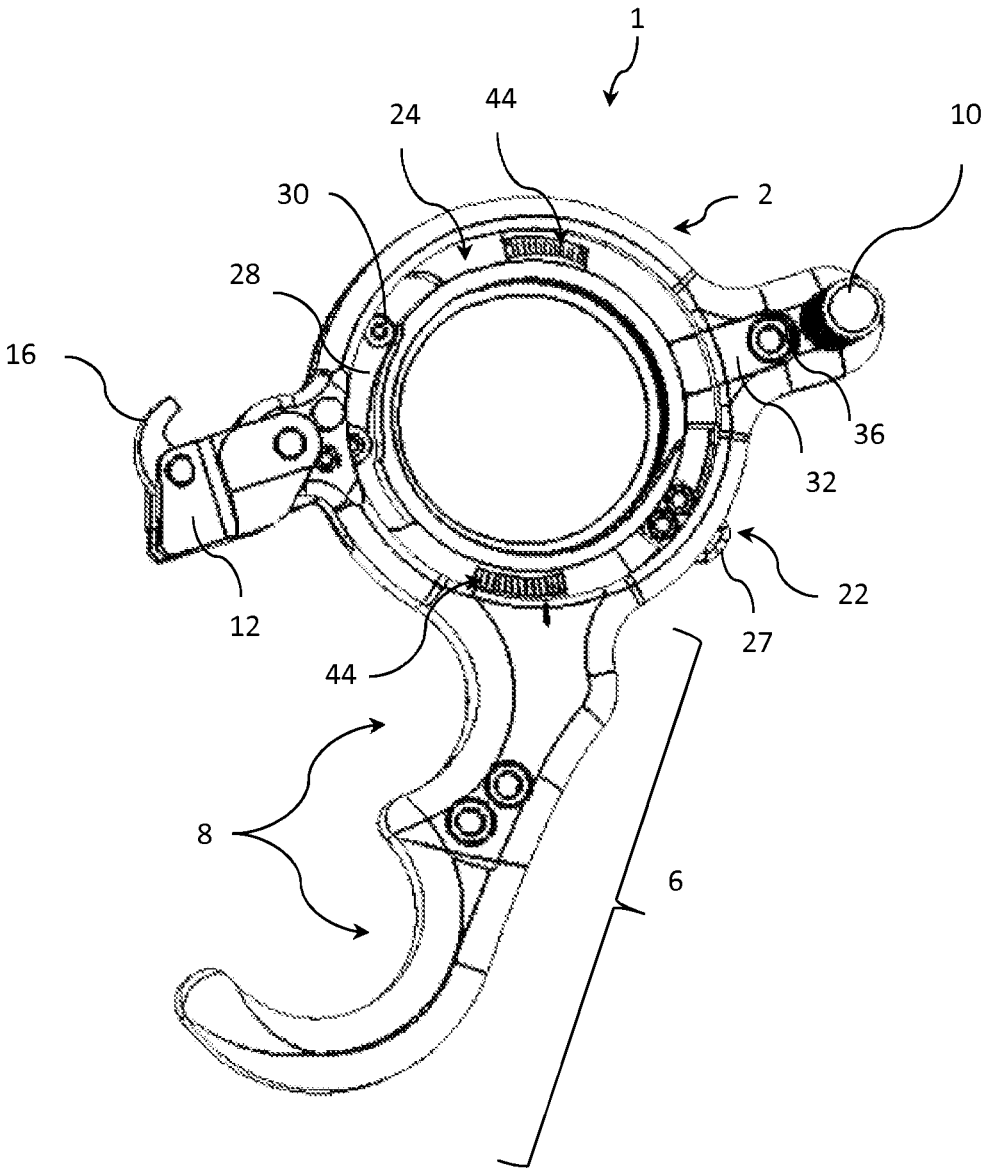
FIG. 5 is a side view of an embodiment of the archery release with a section of the housing removed, illustrating the hook in the hold position or the hold state.

FIG. 1 is a depiction of an example of an archery release 1 in a hold position or hold state. FIGS. 2-5 provide further illustrations of this example. The archery release 1 is configured to be external and non-integral to an archery bow and to be removably coupled to a bowstring or other archery string. Depending upon the embodiment, the archery release 1 can be a trigger-less release, such as a back tension release, or the release 1 can be a trigger-based release. A trigger-less release disengages the bowstring due to the archer's pulling or jerking on the release. The jerking can be caused by tensing of the archer's back, arm or hand muscles. A trigger-based release has a moveable trigger. When the archer pulls or activates the trigger, the trigger-based release disengages the bowstring. In the embodiments shown in the figures, the release 1 has a trigger-less configuration. It should be appreciated, however, that in other embodiments, release 1, or its components, can have a trigger-based configuration.

In an embodiment illustrated in FIGS. 1-5, the archery release 1 includes a housing or release body 2 with an index finger hole or cavity 4 disposed therein. In an embodiment, the archery release 1 includes a finger grip or finger extension 6 for engagement with the middle and ring fingers of the archer. In an example, the finger extension 6 is integral with the release body 2. In another example, the finger extension 6 is coupled to the release body 2 through the use of screws or fasteners 7. In an embodiment, the finger extension 6 includes a wave shape having at least one shaped section or finger grooves 8 configured to position the fingers therein. In an embodiment not shown, the finger extension 6 defines three valleys for ergonomic engagement with the middle, ring and pinky fingers of the archer.

In an embodiment, a thumb rest or thumb grasp 10 is coupled to the release body 2 in a position spaced apart from the finger extension 6. The archer may grasp the archery release 1 by placing his/her index finger in the cavity 4 and his/her remaining fingers in the finger grooves 8. The archer's thumb may rest on the thumb rest 10.

A hook housing, carriage, support or holder 12 is pivotally coupled to the release body 2 through use of a pin, linear fastener or hook holder coupler 14. A hook 16 is moveably or pivotally coupled to the hook holder 12 through use of a pin, linear fastener or hook coupler 18. When the archer is aiming and not yet ready to shoot, the hook 16 is configured to hold the bowstring of a bow at which time the hook 16 is in a hold state or hold position. When the archer is in the process of shooting, the release 1 is in the shooting mode at which time the hook 16 changes to a release state or release position causing the bowstring to be released.

Figure 6:
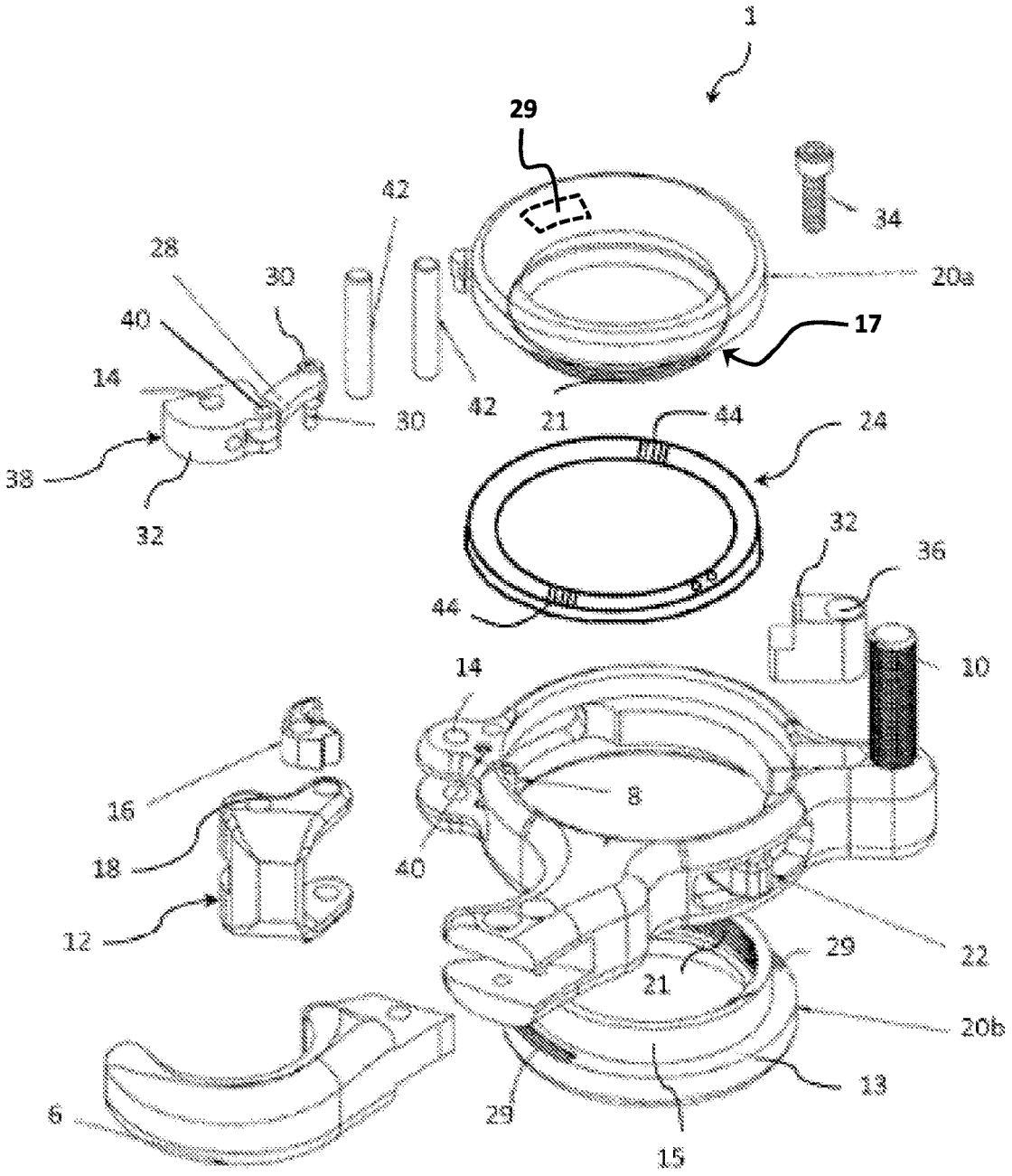
FIG. 6 is an exploded view of an embodiment of the archery release.
Figure 7:
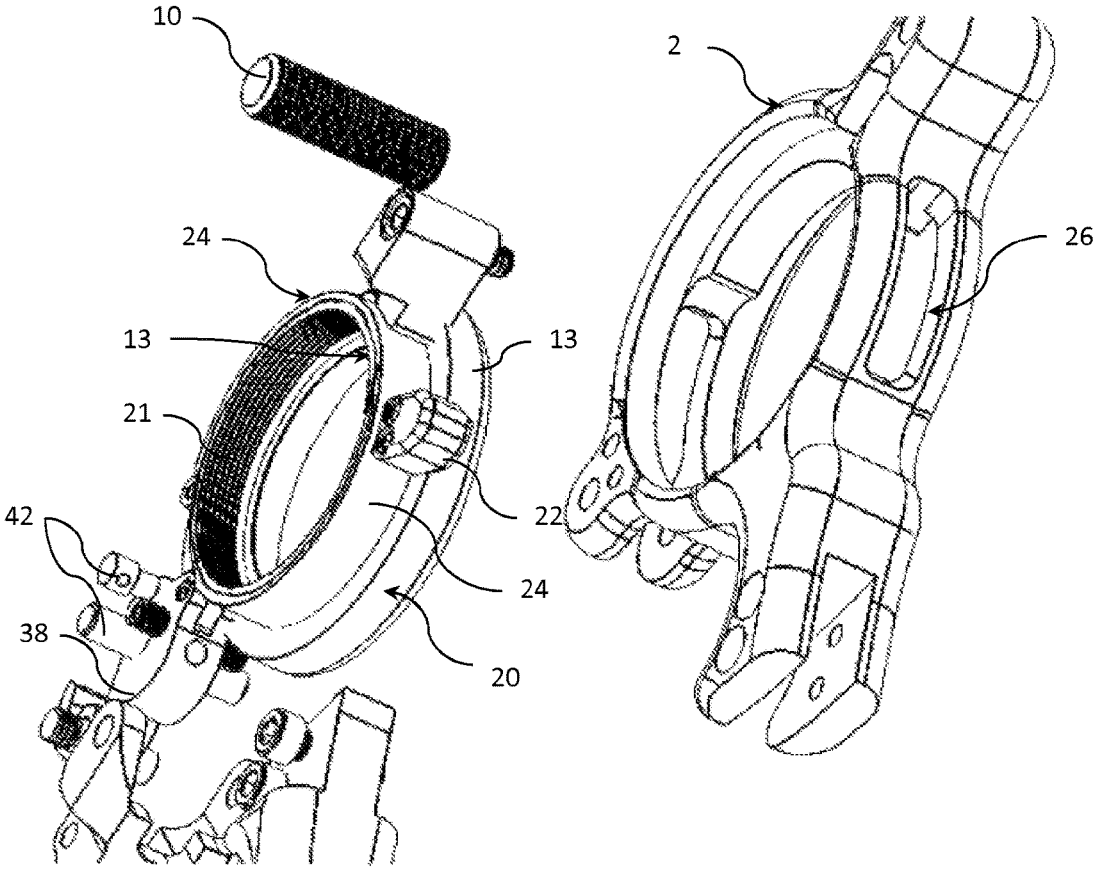
FIG. 7 is another exploded view of an embodiment of the archery release.
Figure 8:
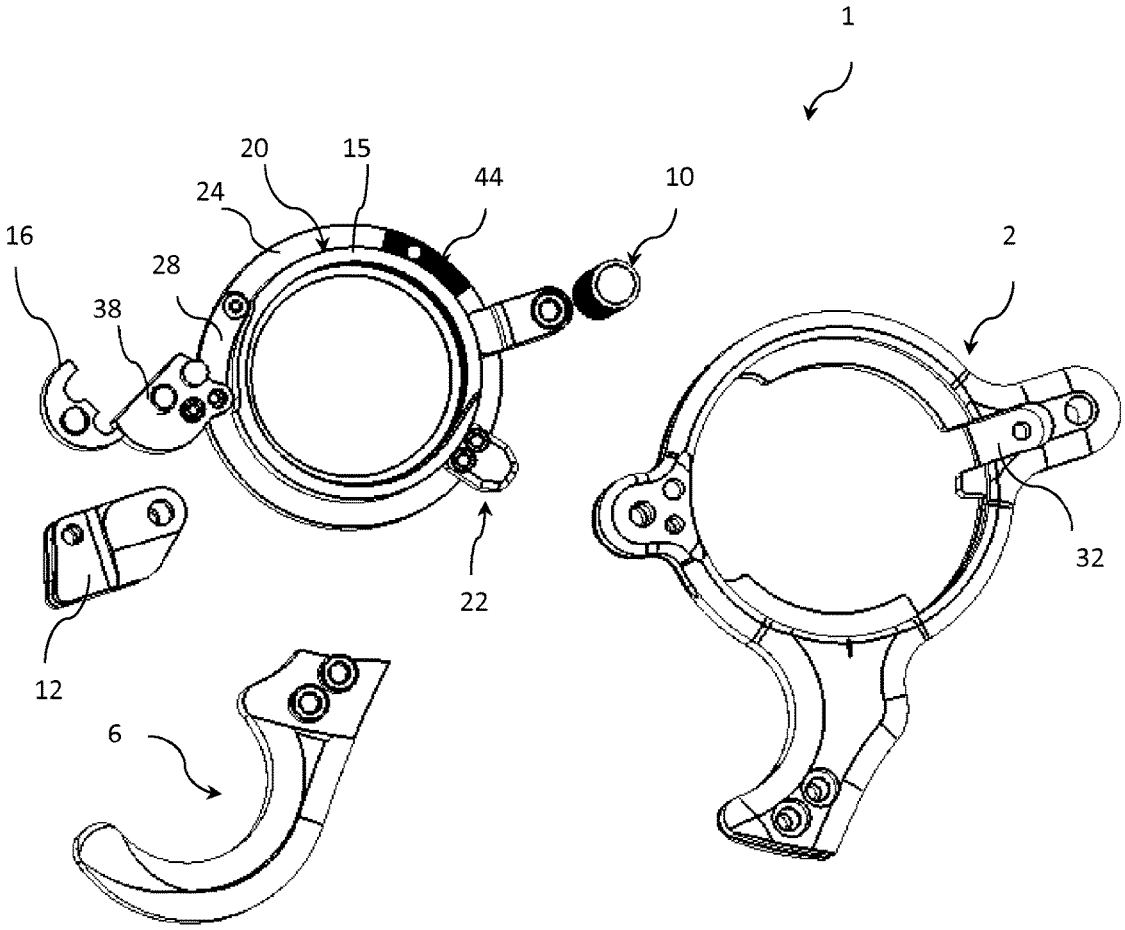
FIG. 8 is another exploded view of an embodiment of the archery release.

Referring to FIGS. 6-8, in an embodiment, the release 1 includes: (a) base ring assembly 20*b* having a shoulder 13 and a neck 15 extending upward from the shoulder 13; (b) a link or driver ring 24 which receives the neck 15 and overlays the shoulder 13; and (c) a securing or coupling ring assembly 20*a* which at least partially inserts into the cavity 4, couples to the base ring assembly 20*b*, such as by screwing or a press-fit, and secures the driver ring 24 to the body 2. In this embodiment, each of the base ring 20*a* and the coupling ring 20*b* includes a threaded surface 21. Upon assembly of the archery release 1, the base ring 20*a* and the coupling ring 20*b* mate or threadably engage at the threaded surfaces 21 to form the ring assembly 20. In an example, the ring assembly 20 is configured to restrain or hold the driver ring 24 at least partially within the cavity 4. It should be appreciated that, depending upon the embodiment, release 1 can include a single ring, such as driver ring 24, moveably coupled to the body 2. In one such embodiment, not shown, the release 1 is configured so that the driver ring 24 is moveably attached to the body 2 without the use of base ring 20*a*, coupling ring 20*b* or ring assembly 20.

Figure 9:
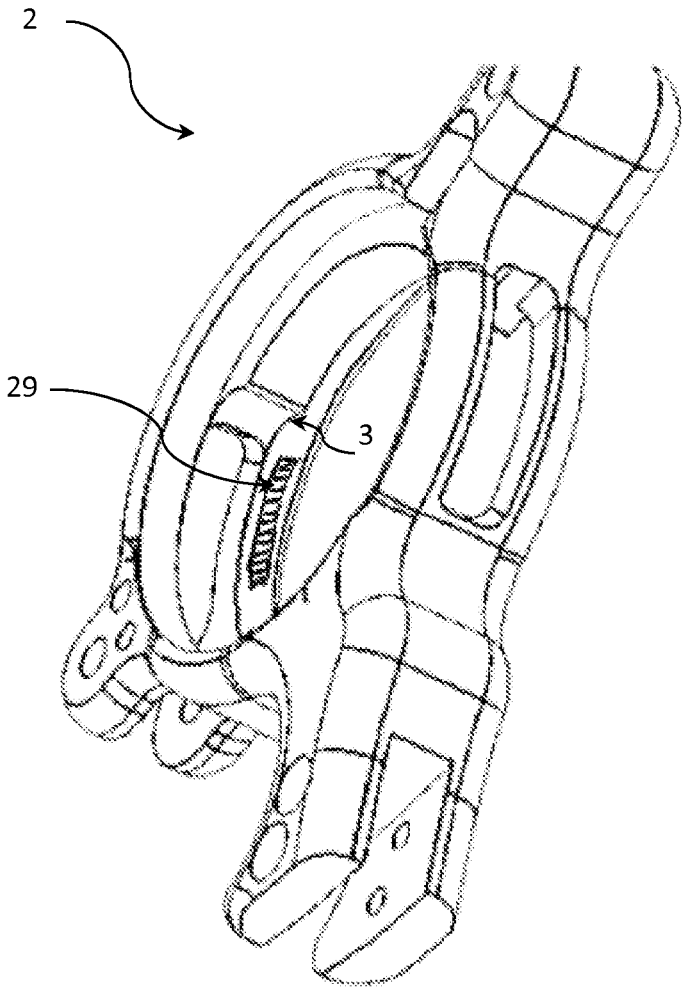
FIG. 9 is a rear isometric view of an embodiment of the housing of the archery release.
Figure 10:
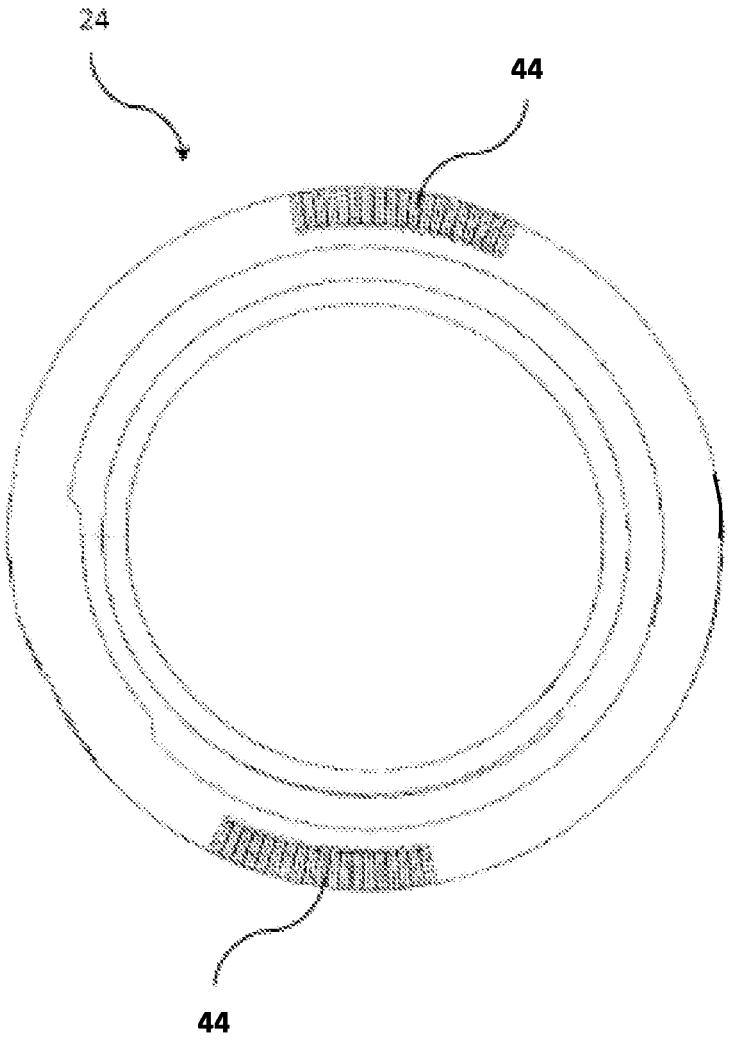
FIG. 10 is a side view of an embodiment of the link ring of an embodiment of the archery release.

In an embodiment, the driver ring 24 includes one or more incremental position control members or friction surfaces 44. Depending upon the embodiment, the friction surfaces 44 can be located on the top of driver ring 24, as shown in FIGS. 6-8 and 11, or the friction surfaces 44 can be located on the bottom of driver ring 24. Likewise, the shoulder 13 (FIG. 6), the body bottom 3 (FIG. 9) or coupling ring bottom 17 (FIG. 6) of the base ring 20*a* includes one or more cooperating incremental position control members or friction surfaces 29. The friction surfaces 44 of the driver ring 24 make physical contact with the friction surfaces 29 to enable incremental or fine control over the rotational position of the driver ring 24 relative to the body 2. In operation, the engagement of the frictional surfaces 44 and 29 prevent the driver ring 24 from freely rotating relative to the body 2. In an example, each of the friction surfaces 44 and 29 includes a plurality of teeth, ridges, one or more detents, one or more protrusions, grooves or other suitable engagement members. The engagements members of each friction surface 44 are configured to mate or frictionally cooperate with the engagement members of the interfacing friction surface 29. In an example, the friction surfaces 44 and 29 form a gear system that permits incrementally controlled rotation of the driver ring 24 relative to the body 2.

Figure 11:
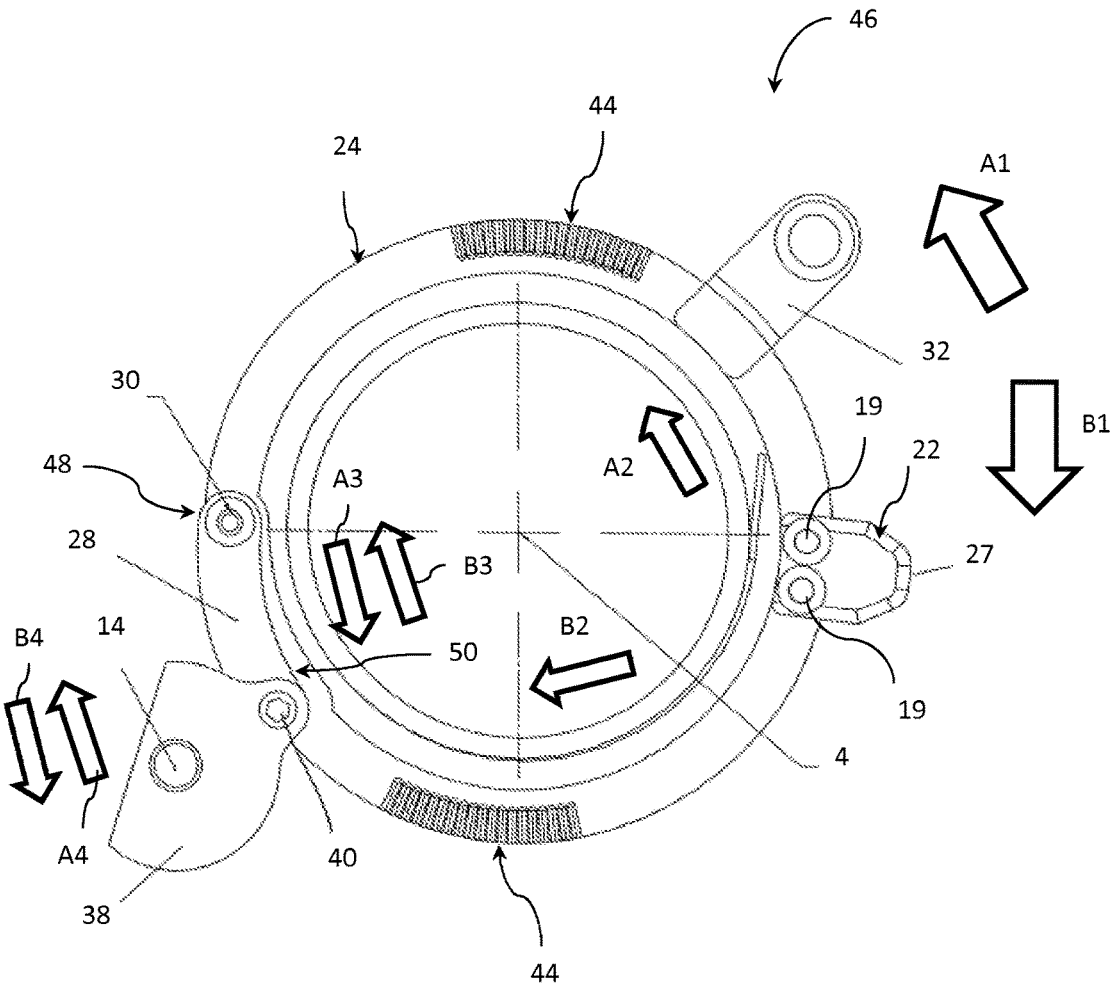
FIG. 11 is a side view of an embodiment of the linkage system.
Figure 12:
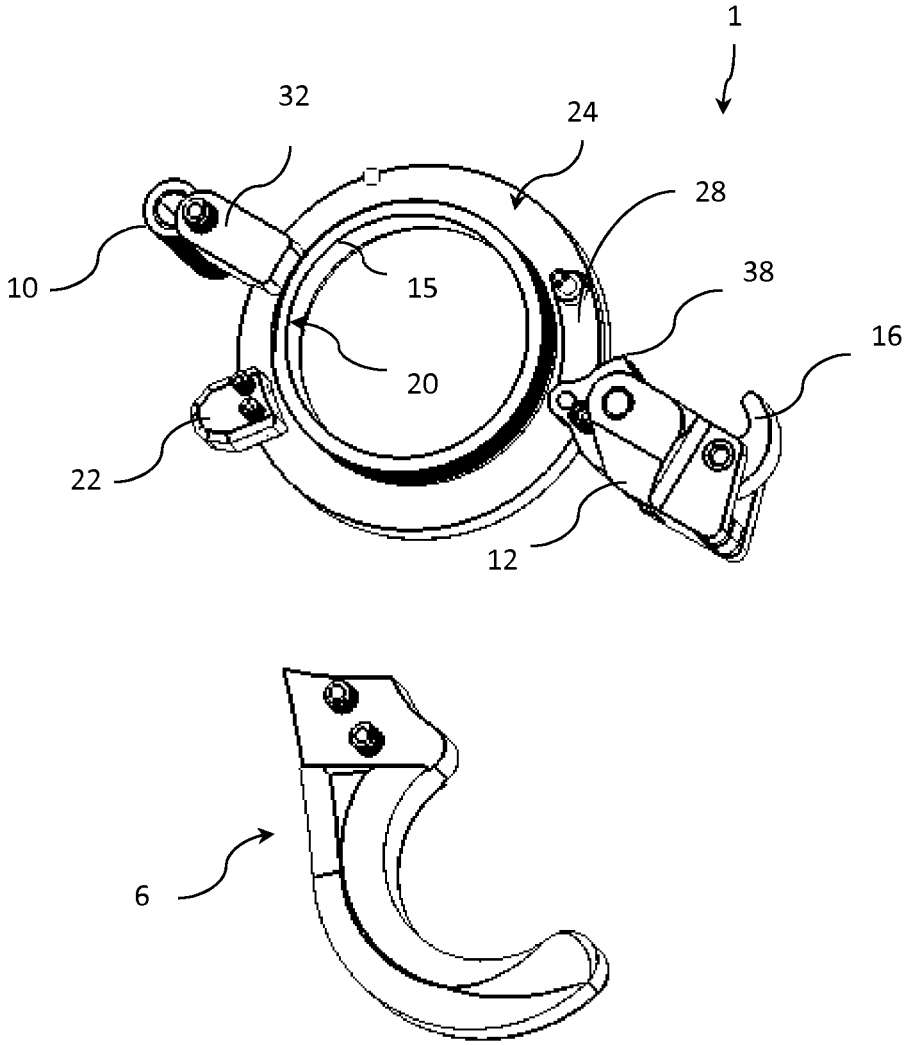
FIG. 12 is a side view of an embodiment of the archery release with the housing removed, illustrating the linkage system.
Figure 13:
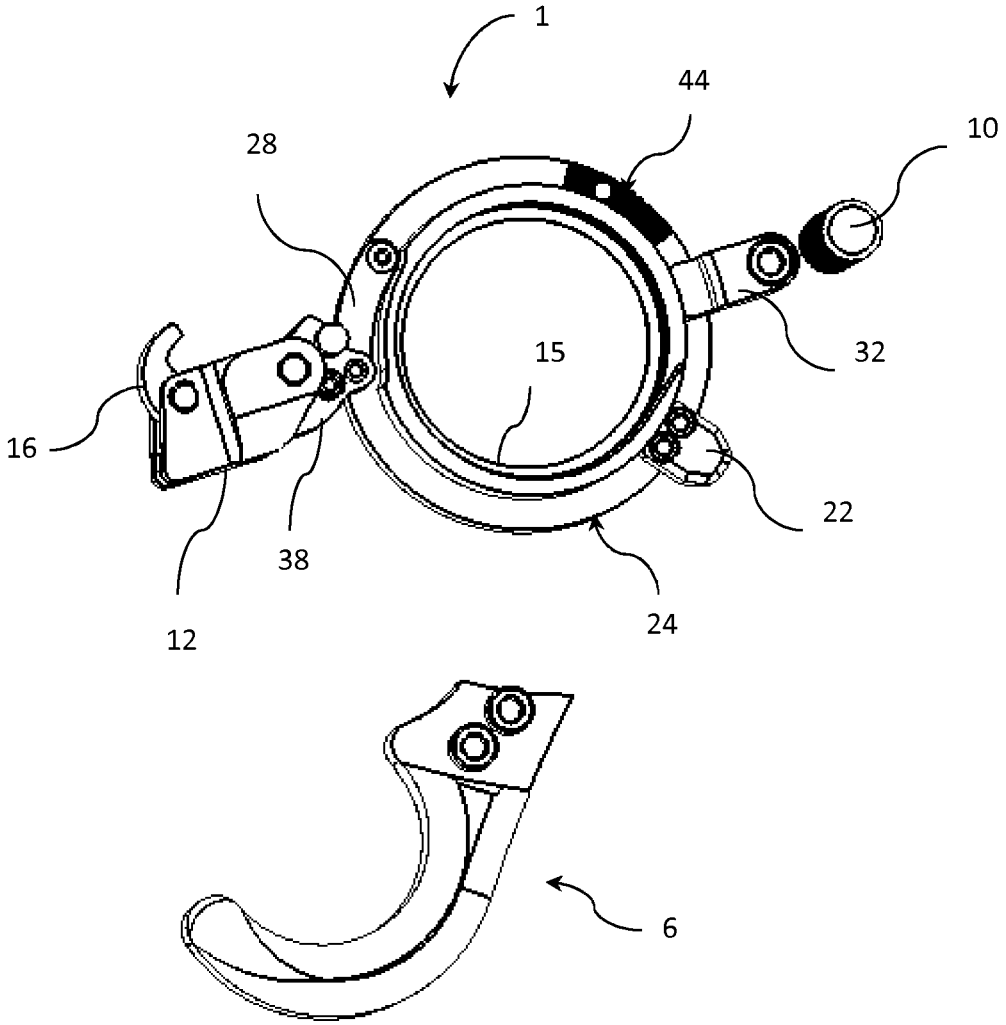
FIG. 13 is a side view of an embodiment of the archery release with part of the housing removed, illustrating the linkage system.
Figure 14:
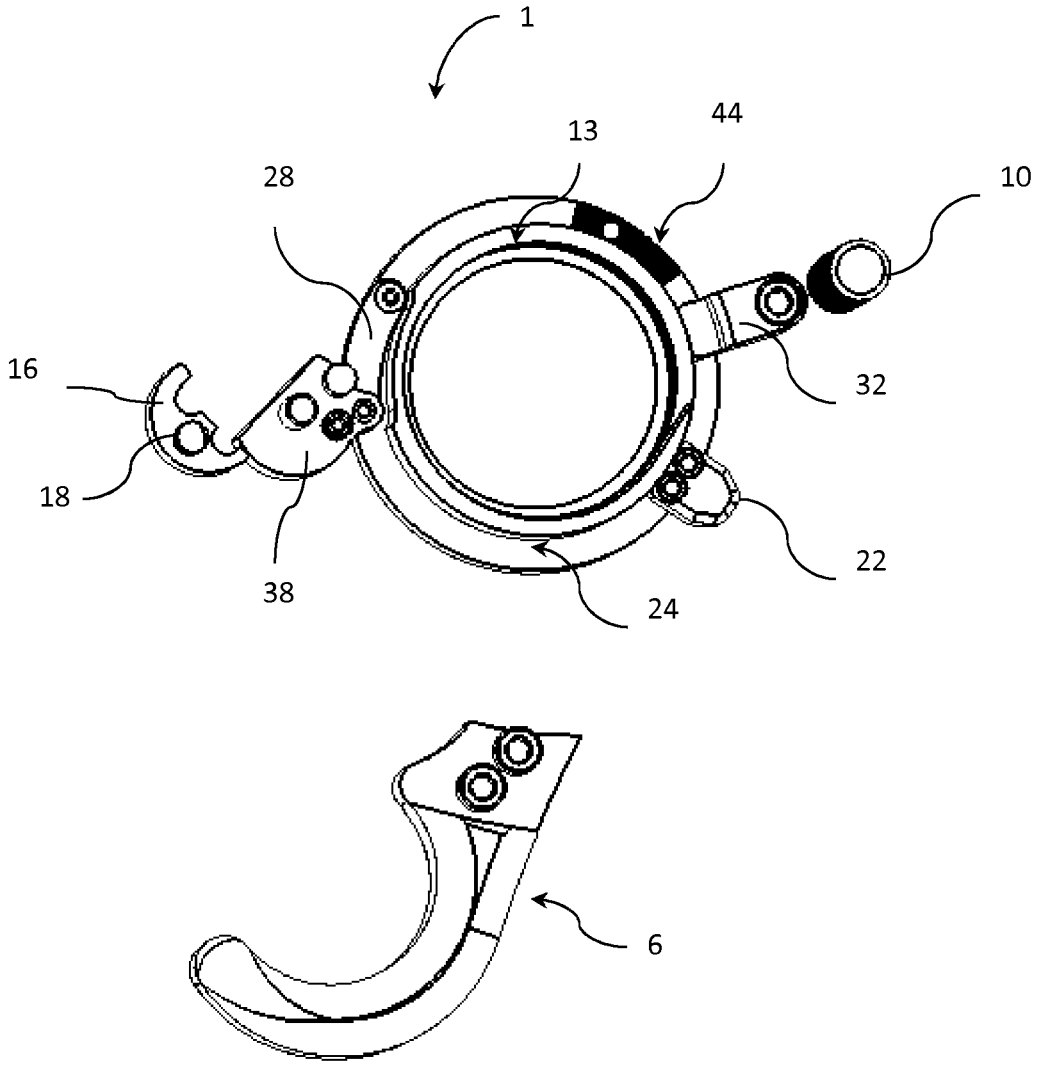
FIG. 14 is another side view of an embodiment of the archery release with the housing removed, illustrating the linkage system.

As described further below, a sensitivity adjuster tab 22 is coupled to the driver ring 24 (FIG. 11). Depending upon the embodiment, the sensitivity adjuster tab 22 can be a finger tab, thumb tab or other control element positioned at least partially in the cavity 4. The archer can push the sensitivity adjuster tab 22 with his/her thumb or other finger to change the rotational position of the driver ring 24 relative to the body 2. In an embodiment, a plurality of screws, pins or other fasteners 19 are used to couple the sensitivity adjuster tab 22 to the driver ring 24. The head 27 of the sensitivity adjuster tab 22 extends through a tab opening 26 in the release body 2.

Referring to FIGS. 6 and 11, in an embodiment, the driver ring 24 is coupled to a linkage member 28 through a linkage pivot coupler 30, such as a pin. As further illustrated by FIG.

6, the linkage member 28 is coupled to a moon-shaped member, cam, hook engager or sear 38 through a sear pivot coupler 40, such as a pin. The hook holder 12 is coupled to both the release body 2 and the sear 38 at pivot axis 14. In an embodiment, a pivot member or pin 42 is disposed within the passage along pivot axis 14, and pins 42 are embodiments of the hook coupler 18, the linkage pivot coupler 30, and the sear pivot coupler 40, forming pivot points.

The archery release 1 additionally includes a drive ring position maintainer, ring clamp, or position lock 32. This position lock 32 is configured to hold the driver ring 24 in a desired rotational position. In an example, further illustrated by FIG. 6, a fastener 34 is positioned in a hole or recess 36 in the position lock 32. In an example, the fastener 34 is a screw. When the screw is tightened, the position lock 32 presses against the driver ring 24, preventing rotation of the driver ring 24. When the fastener 34 is loosened sufficiently, the archer can frictionally rotate the driver ring 24 by operating the sensitivity adjuster tab 22. The position lock 32 can be shaped to hold the driver ring 24 within the cavity 4, even when the fastener 34 is loosened.

In an embodiment illustrated in FIG. 11, the release 1 includes a linkage system 46. The linkage system 46 includes the driver ring 24, to which is coupled the sensitivity adjuster tab 22. As described above, the driver ring 24 includes at least one friction surface 44. The driver ring 24 is coupled to the linkage member 28 through the linkage pivot member 30, located at a first end 48 of the linkage member 28. At a second end 50 of the linkage member 28, the linkage member 28 is coupled to the sear 38 through the sear pivot member 40. As described above, the hook holder 12 is coupled to the release body 2 through the hook holder coupler 14, which also extends through the sear 38. These two pivot members 14, 40 extend through the sear 38. Pivot member 40 drives the sear 38 clockwise or counterclockwise, causing sear 38 to rotate about pivot member 14. The linkage member 28 controls and sets the position of pivot member 40 which, in turn, controls and sets the position of sear 38.

Figure 15:
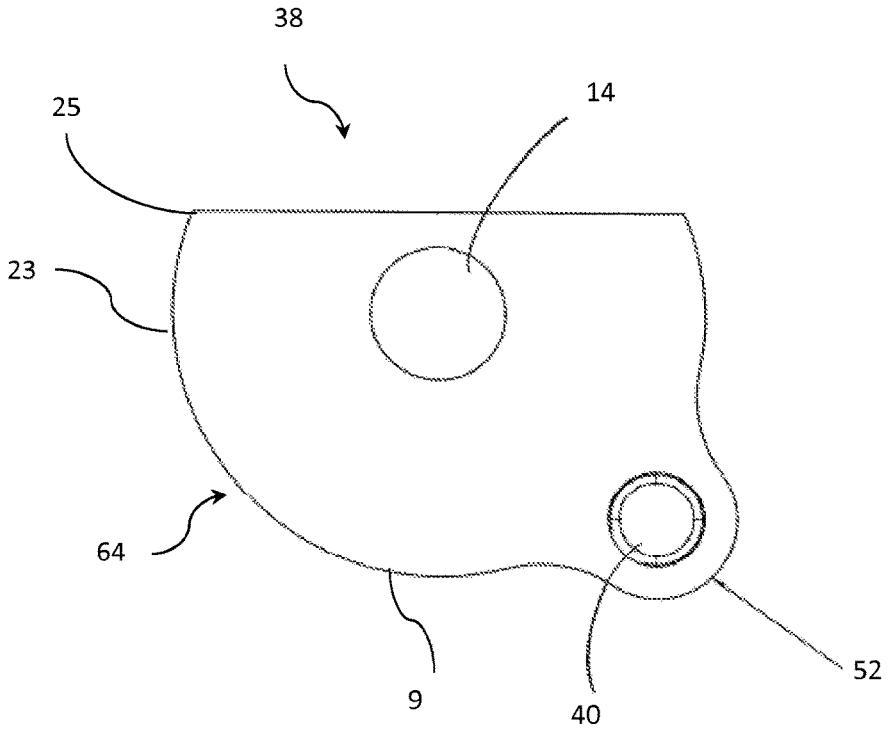
FIG. 15 is a side view of an embodiment of the sear.
Figure 16:
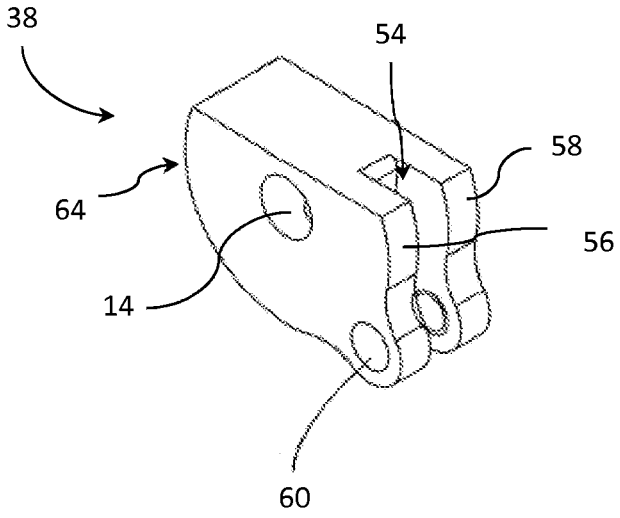
FIG. 16 is an isometric view of an embodiment of the sear.
Figure 17:
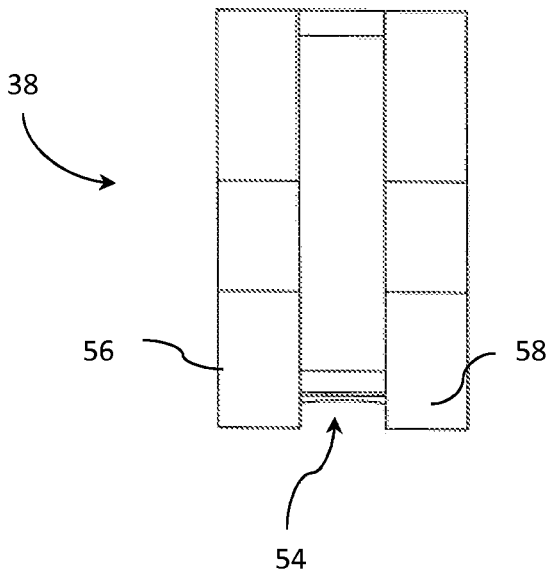
FIG. 17 is a rear view of an embodiment of the sear.

As illustrated by FIGS. 15-17, in an example, viewed from the side, the sear 38 has a moon or half-circle shape with a protrusion 52 extending from the rear surface to receive the sear pivot member 40. The rear surface includes a valley 54 extending between a first lip 56 and a second lip 58. A hole or recess 60 extends through the first and second lip 56, 58. The second end 50 (FIG. 11) of the linkage member 28 is disposed in the valley 54, and pivot member 40 is positioned in the hole 60 and through the linkage member 28, forming the sear pivot point. The sear 38 additionally includes a hook engager portion 64 configured to engage the hook 16 when the hook is in the non-release or hold position. In an example, the hook engager portion 64 is the upper surface of the sear 38, which is a substantially flat or non-curved surface.

Before placing the archery release 1 on the bowstring of a bow, the sensitivity of the archery release 1 can be set or adjusted. As illustrated in FIG. 11, in an embodiment, sensitivity adjuster tab 22 is coupled to the driver ring 24 so that when sensitivity adjuster tab 22 is moved upward in direction A1, the driver ring 24 rotates in direction A2. This rotation of the driver ring 24 drives the linkage member 28 in direction A3, causing the sear 38 to rotate in direction A4. When sensitivity adjuster tab 22 is moved downward in direction B1, the driver ring 24 rotates in direction B2. This rotation of driver ring 24 drives the linkage member 28 in direction B3, causing the sear 38 to rotate in direction B4. Accordingly, by incrementally pushing the sensitivity adjuster tab 22 upward or downward, the archer can change and set the position of the sear 38. Because the sear 38 controls the release sensitivity of the hook 16, the archer can adjust this sensitivity by operating the sensitivity adjuster tab 22 before shooting.

Figure 18:
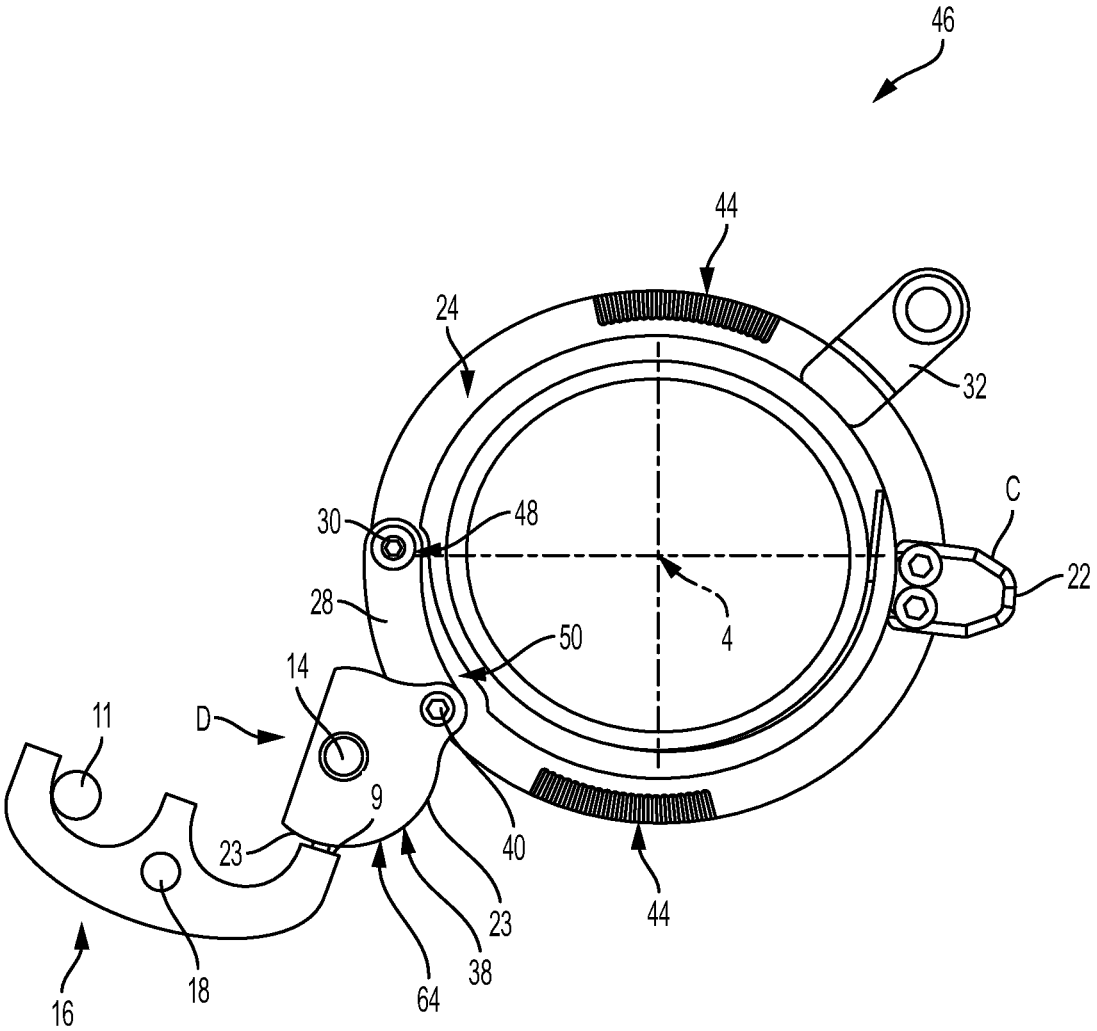
FIG. 18 is a side view of an embodiment of the linkage system illustrating the system in a high sensitivity configuration or position.

In an embodiment, the rotation of the sear 38 around the sear pivot member 40 changes the orientation of the hook engager portion 64 relative to the hook 16, enabling more or less of the hook engager portion 64 to engage the hook and thus changing the sensitivity of the release 1. In an example illustrated in FIG. 18, the archer slid tab 22 until reaching tab position C. This caused the hook engagement surface 23 to face downward in sear position D where it abuts the hook end 9. The sear 38 was then fixed or set in this sear position D for shooting mode. Since the hook engagement surface 23 is located relatively close to the release edge 130, the hook end 9 has a relatively low amount of rotation necessary to clear the sear 38 for releasing the bowstring 11. In operation, the bowstring 11 applies a pulling force to the hook 16 until the hook end 9 slides past the hook engagement surface 23. After sliding past, the hook 16 rotates counterclockwise about pivot member 18 until the bowstring 11 slides out of the hook 16. In this example, the archer used sensitivity adjuster tab 22 to set the shooting position of the sear 38 for a moderate or relatively high level of sensitivity which, in turn, enabled the bowstring 11 to slide out of the hook 16 with relative ease.

Figure 19:
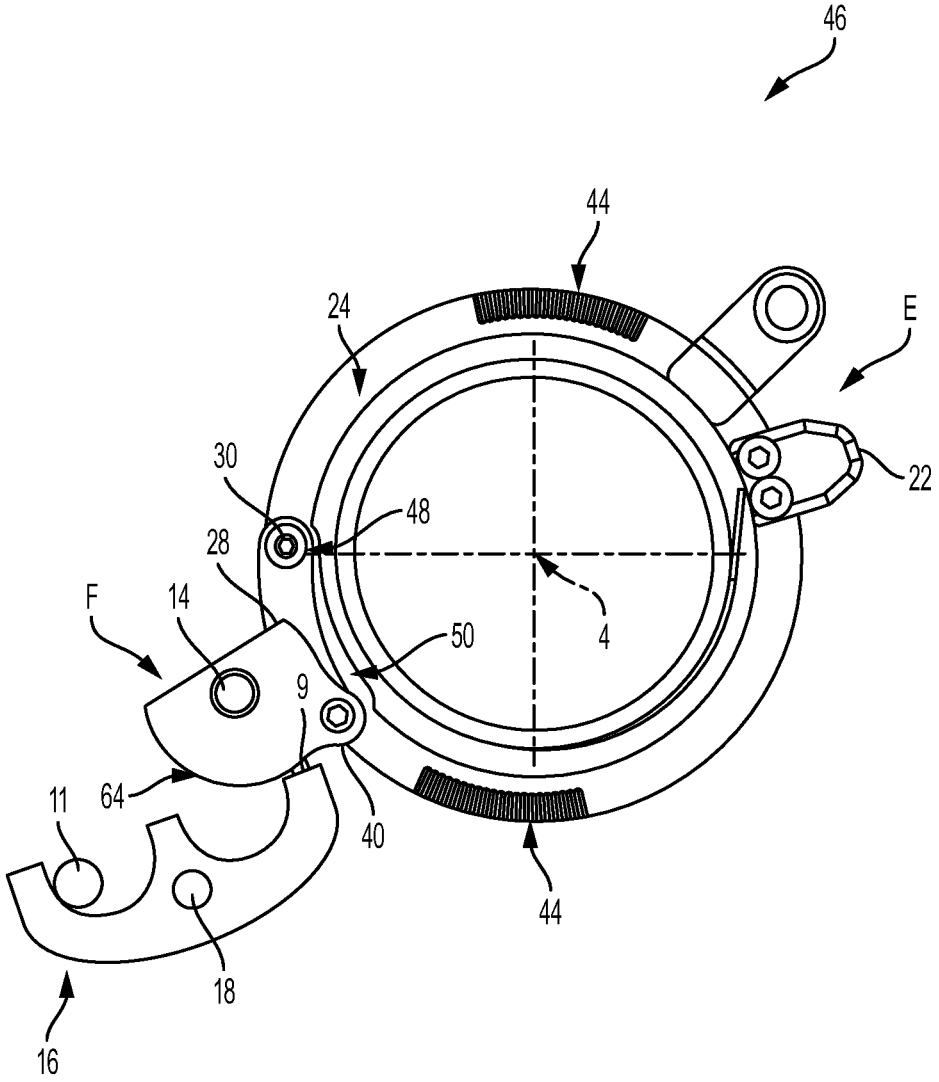
FIG. 19 is a side view of an embodiment of the linkage system illustrating the system in a low sensitivity configuration or position.

In an example illustrated in FIG. 19, the archer slid tab 22 until reaching tab position E. This caused the hook engagement surface 9 to face downward in sear position F where it abuts the hook end 9. The sear 38 was then fixed or set in this sear position F for shooting mode. Since the hook engagement surface 9 is located relatively far away from the release edge 130, the hook end 9 has a relatively high amount of rotation necessary to clear the sear 38 for releasing the bowstring 11. In operation, the bowstring 11 applies a pulling force to the hook 16. Eventually, after a relatively high amount of travel, the hook end 9 slides past the hook engagement surface 23. After sliding past, the hook 16 rotates counterclockwise about pivot member 18 until the bowstring 11 slides out of the hook 16. In this example, the archer used sensitivity adjuster tab 22 to set the shooting position of the sear 38 for a relatively low level of sensitivity which, in turn, enabled the bowstring 11 to slide out of the hook 16 after a relatively high amount of arm or back pulling force by the archer.

In an embodiment, the hook 16 is pivotal through a range of pre-release hook positions relative to the release body 2. The head 27 of the sensitivity adjustment device or tab 22 is configured to be moved relative to the release body 2 through a range of head positions. The hook engager or sear 38 is configured to engage the hook 16 when the hook 16 holds the bowstring 11. The bowstring release 1 is operable in an adjustment mode in which: (a) the head 27 is configured to receive an adjustment force from the archer; and (b) at least one ring, such as the link ring 24, is configured to rotate relative to the release body 2 in response to the adjustment force. This rotation occurs through a range of ring positions. Also, during the adjustment mode, the sear 38 is configured to pivot in response to the rotation. The pivoting of the sear 38 causes the hook 16 to have one of the pre-release hook positions. During the adjustment mode, the friction surfaces 44 enable the archer to gradually or incrementally adjust the sensitivity of the release 1. After reaching or engaging the desired setting, the archer can operate the ring lock 5 to secure the link ring 24 in a desired one of the ring positions so as to maintain the hook 16 in the desired pre-release hook position. Then, the archer can operate the bowstring release 1 in a shooting mode in which the hook 16 is configured to release the bowstring 11 with a sensitivity based, at least in part, on the pre-release hook position.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A bowstring release comprising:

a release body defining a cavity;

a hook pivotally coupled to the release body, the hook configured to hold a bowstring;

a ring at least partially positioned within the cavity;

a sensitivity adjustment device coupled to the ring, the sensitivity adjustment device comprising a head configured to be moved relative to the release body through a range of head positions;

a hook engager pivotally coupled to the release body, the hook engager configured to engage the hook when the hook holds the bowstring, the hook engager being pivotal between a plurality of hook engager positions relative to the hook; and a ring lock configured to maintain a ring position of the ring relative to the release body, wherein the bowstring release is operable in an adjustment mode in which:

the head is configured to receive an adjustment force;

the ring is configured to rotate relative to the release body in response to the adjustment force, the rotation occurring through a range of ring positions;

the hook engager is configured to pivot in response to the rotation; and the ring lock is configured to secure the ring in a desired one of the ring positions so as to maintain the hook engager in one of the hook engager positions, wherein the bowstring release is operable in a shooting mode in which the hook is configured to disengage from the hook engager based, at least in part, on the hook engager position, and wherein the disengagement causes the bowstring to be released.

2. The bowstring release of claim 1, wherein: (a) the ring defines a hole; and (b) the ring is configured to be coupled to the hook engager so that the rotation of the ring causes pivoting of the hook engager.

3. The bowstring release of claim 1, wherein the ring is configured to rotate in a direction in which the adjustment force is applied.

4. The bowstring release of claim 3, wherein the hook engager is configured to rotate in a direction opposite the direction in which the adjustment force is applied.

5. The bowstring release of claim 1, wherein:

in the shooting mode, the hook engager is configured to interfere with the hook during the pivoting of the hook until a release force, acting on the hook, causes the hook to clear the hook engager;

the release force comprises a magnitude necessary to cause the hook to clear the hook engager; and the magnitude depends on which one of the ring positions is secured by the ring lock.

6. The bowstring release of claim 1, wherein the hook engager comprises a sear.

7. A bowstring release comprising:

a release body defining a cavity;

a hook moveably coupled to the release body, the hook configured to hold a bowstring; and a linkage system positioned at least partially within the cavity, the linkage system comprising:

(a) a ring moveably coupled to the release body, the ring being at least partially positioned in the cavity;

(b) a tab coupled to the ring;

(c) a sear pivotally coupled to the release body, the sear comprising a hook engager portion configured to engage the hook when the hook holds the bowstring; and (d) a position retainer configured to maintain a position of the ring, wherein, in response to operation of the tab to adjust the bowstring release prior to coupling the hook to the bowstring, (i) the ring is configured to rotate; and (ii) the sear is configured to rotate in response to rotation of the ring, changing a position of the hook engager portion relative to the hook, thereby changing a sensitivity of the bowstring release.

8. The bowstring release of claim 7, wherein the release body comprises a housing configured to house at least part of the ring.

9. The bowstring release of claim 8, wherein the ring comprises a first friction surface, the bowstring release comprising a second friction surface, the first and second friction surfaces configured to engage each other during the rotation of the ring.

10. The bowstring release of claim 7, wherein: (a) the ring defines an opening; and (b) the ring is operatively coupled to the sear.

11. The bowstring release of claim 7, wherein decreasing the sensitivity of the bowstring release comprises increasing an amount of which the hook engager portion blocks the hook.

12. The bowstring release of claim 7, wherein increasing the sensitivity of the bowstring release comprises decreasing an amount of which the hook engager portion blocks the hook.

13. The bowstring release of claim 7, wherein changing the position of the hook engager portion comprises rotating the sear around a sear pivot point.

14. A bowstring release comprising:

a release body defining a cavity;

a hook moveably coupled to the release body, the hook configured to hold a bowstring; and a linkage system positioned at least partially within the cavity, the linkage system comprising:

(a) a first ring rotatably coupled to the release body, the first ring being at least partially positioned in the cavity;

(b) a second ring at least partially positioned in the cavity and configured to retain the first ring in the cavity;

(c) a tab coupled to the first ring and extending through the release body to rotate the first ring;

(d) a linkage member pivotally coupled to the first ring at a first end of the linkage member; and (e) a sear pivotally coupled to a second end of the linkage member, the sear comprising a hook engager portion configured to block the hook when the hook holds the bowstring; and a position retainer coupled to the release body, the position retainer being configured to maintain a position of the first ring relative to the release body;

a first friction member coupled to the first ring; and a second friction member coupled to the release body, the second friction member configured to cooperatively engage the first friction member to facilitate controlling the rotation of the first ring relative to the release body, wherein, in response to operation of the tab to adjust the bowstring release prior to coupling the hook to the bowstring, (i) the first ring is configured to rotate; (ii) the linkage member is configured to change position, and (iii) the sear is configured to rotate in response to the change in position of the linkage member, and wherein the rotation of the sear changes a position of the hook engager portion relative to the hook, thereby changing a sensitivity of the bowstring release.

15. The bowstring release of claim 14, wherein when the first ring rotates in a first direction, the linkage member is configured to extend, causing the sear to rotate in a second direction opposite the first direction.

16. The bowstring release of claim 14, wherein when the first ring rotates in a second direction, the linkage member is configured to retract, causing the sear to rotate in a first direction, opposite the second direction.

17. The bowstring release of claim 14, wherein the first friction member comprises a plurality of grooves, and the second friction member comprises at least one protrusion configured to engage the plurality of grooves.

18. The bowstring release of claim 14, wherein:

decreasing the sensitivity of the bowstring release comprises increasing an amount of the hook engager portion configured to engage the hook; and increasing the sensitivity of the bowstring release comprises decreasing an amount of the hook engager portion configured to engage the hook.

19. The bowstring release of claim 14, wherein the second ring comprises the second friction member.

20. The bowstring release of claim 14, wherein the second ring comprises a pair of rings configured to threadably engage each other to form the second ring.

* * * * *